US007274340B2

(12) United States Patent
Ozden et al.

(10) Patent No.: US 7,274,340 B2
(45) Date of Patent: Sep. 25, 2007

(54) QUAD-BAND COUPLING ELEMENT ANTENNA STRUCTURE

(75) Inventors: Sinasi Ozden, Copenhagen (DK); Bjarne K. Nielsen, Kobenhavn (DK); Claus H. Jorgensen, Kobenhavn (DK); Juha Villanen, Espoo (FI); Clemens Icheln, Espoo (FI); Pertti Vainikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/321,016

(22) Filed: Dec. 28, 2005

(65) Prior Publication Data

US 2007/0146212 A1 Jun. 28, 2007

(51) Int. Cl.
*H01Q 1/50* (2006.01)
*H01Q 9/16* (2006.01)

(52) U.S. Cl. ..... 343/860; 343/822; 343/700 MS; 343/702; 343/846

(58) Field of Classification Search ..... 343/860, 343/822
See application file for complete search history.

(56) References Cited

U.S. PATENT DOCUMENTS

| | | | | |
|---|---|---|---|---|
| 5,914,690 | A | 6/1999 | Lehtola et al. | 343/702 |
| 6,674,411 | B2 | 1/2004 | Boyle | 343/860 |
| 7,180,464 | B2 * | 2/2007 | Chiang et al. | 343/833 |
| 2005/0007291 | A1 * | 1/2005 | Fabrega-Sanchez et al. | 343/860 |
| 2005/0184914 | A1 * | 8/2005 | Ollikainen et al. | 343/702 |
| 2005/0212706 | A1 * | 9/2005 | Ying et al. | 343/702 |

FOREIGN PATENT DOCUMENTS

| | | | |
|---|---|---|---|
| CH | 694625 | A5 | 4/2005 |
| FI | 20002529 | | 5/2002 |
| FI | 114260 | B | 5/2004 |
| WO | WO-03/094346 | A1 | 11/2003 |

OTHER PUBLICATIONS

"Resonator-Based Analysis of the Combination of Mobile Handset Antenna and Chassis", Vainikainen, Pertti, IEEE Transactions on Antennas and Propagation, vol. 50, No. 10, Oct. 2002, pp. 1433-1444.

* cited by examiner

*Primary Examiner*—Trinh Vo Dinh
(74) *Attorney, Agent, or Firm*—Harrington & Smith, PC

(57) ABSTRACT

An antenna module has a substrate, first and second coupling elements, and first and second resonant circuits disposed on the substrate. The first and second coupling elements are mounted to the substrate and particularly adapted to couple respective first and second frequency bands to a ground plane through respective first and second ports. The first resonant circuit has a plurality of components having electrical values selected so as to function as a band-pass filter within the first frequency band and to present a high impedance at least in the second frequency band. The second resonant circuit is coupled to the second port and has a plurality of components that have electrical values selected so as to function as a band-pass filter within the second frequency band and to present a high impedance at least in the first frequency band.

22 Claims, 12 Drawing Sheets

○ 0.5000(−7.236, 50.47)Ohm
□1 1.600(49.47, −84.88)Ohm
□2 1.825(42.33, −56.88)Ohm
• 3.000(2.207, −23.73)Ohm

QUAD-BAND COUPLING ELEMENT ANTENNA STRUCTURE

TECHNICAL FIELD

This invention relates generally to radio frequency (RF) antennas and, more specifically, relate to matching circuits for use with multi-port antennas, such as those used in multi-frequency band (multi-band) communication terminals, also referred to as mobile stations.

BACKGROUND

A known technique for performing multi-band antenna matching tunes the antenna structure itself. However, this can become a complicated process if the antenna has many frequency bands. In addition, multiple antenna feeds are used rarely because of the poor isolation between ports.

A persistent problem with mobile station antennas is the need to decrease the antenna volume while covering more frequency bands. It is well known that, especially in the GSM850/900 bands, the chassis of a mobile station may function as the main radiator. The antenna element can be understood as a matching circuit and a coupling element between the port of the antenna and the chassis of the mobile station. In order to be able to implement a wideband antenna in a small volume, it is necessary that the antenna element couples strongly and efficiently to the characteristic wavemode of the chassis.

It can be determined that the strongest coupling to the chassis wavemode can be achieved at the corners and shorter ends of the internal ground plane. A strong coupling to the chassis wavemode requires the maximum of the electric field of the antenna element to be located near the maximum of the electric field of the chassis. In addition, the electric field strength all around the antenna element should be as high as possible, i.e. the volume of the antenna should be used efficiently. In this respect, the structure of one of the most commonly used internal mobile station antenna, the PIFA, is not optimal. Near the shorting pin of the PIFA, the voltage and thus also the electric field strength is low. Also, the requirement of self-resonance is a limiting factor for an antenna designer for two different reasons. First, due to the self-resonance, the space requirements of the PIFA at low frequencies, e.g. at the GSM850/900 bands, are rather high. As a consequence, some type of meandering of the antenna element is needed in order to reduce its total volume. Second, owing to the meandering at the lower frequencies, it becomes difficult to optimally shape the PIFA according to the high-coupling locations of the chassis.

It is believed that stronger coupling to the chassis wavemode has been primarily achieved by moving the antenna element (PIFA) partly over the edge of the chassis. Multi-band/multi-resonant mobile station antennas have traditionally been implemented using multi-resonant antenna elements and parasitic resonators.

SUMMARY

The foregoing and other problems are overcome, and other advantages are realized, in accordance with the presently preferred embodiments of this invention.

An exemplary aspect of this invention is an antenna module that includes a substrate, first and second coupling elements, and first and second resonant matching circuits. The substrate is insulating. The first coupling element is mounted to the substrate and particularly adapted to couple a first frequency band to a ground plane through a first port. The second coupling element is also mounted to the substrate, and is particularly adapted to couple a second frequency band to a ground plane through a second port. The ground plane may be the same, but is not itself a part of the antenna module. The first resonant matching circuit is coupled to the first port and is disposed on the substrate and has a plurality of components having electrical values selected so as to function as a band-pass filter within the first frequency band and to present a high impedance at least in the second frequency band. Similarly, the second resonant matching circuit is coupled to the second port and is also disposed on the substrate. The second series matching circuit has a plurality of components that have electrical values selected so as to function as a band-pass filter within the second frequency band and to present a high impedance at least in the first frequency band.

In another aspect, the invention is multi-band antenna that has a ground plane, a first and second coupling element, and a first and second matching circuit. The first coupling element defines a first port that is coupled to the ground plane, and is for exciting the ground plane with radio signals. The first matching circuit is coupled at a first end to the first port and defines an opposed feed end. The first matching circuit is for attenuating radio signals outside a first frequency band. The second coupling element is isolated from the first coupling element and defines a second port that is coupled to the ground plane. The second coupling element is for exciting the ground plane with radio signals. The second matching circuit is coupled at a first end to the second port, and defines an opposed free end. The second matching circuit is for attenuating radio signals outside a second frequency band. The feed ends are connected at a common feed, which is for coupling to a transceiver. Further, the coupling elements are disposed adjacent to a transverse edge of the ground plane and not overlying a major surface of the ground plane.

Another exemplary aspect of this invention is a method for coupling an antenna main radiator element to a transceiver. In the method, a printed wiring board PWB is provided, which acts as the main radiator element during operation. A first coupling element is coupled to the PWB at a first port and a second coupling element is coupled to the PWB at a second port. The first and second coupling elements are for exciting currents within respective first and second radiofrequency RF bands to the PWB. A first matching circuit is disposed between the first port and a transceiver, and the first matching circuit is for passing currents within the first RF band and for attenuating currents within the second RF band. Similarly, a second matching circuit is disposed between the second port and a transceiver. The second matching circuit is for passing currents within the second RF band and for attenuating currents within the first RF band. The first and second RF bands are characterized in that they do not overlap.

In accordance with another embodiment is a mobile terminal that includes a first and a second main body section moveable relative to one another between an open and a closed position, a transceiver, a printed wiring board PWB defining a ground plane, and an antenna module. The PWB is disposed in the first main body section and defines opposed lateral edges and a transverse edge. The antenna module includes first and second coupling elements, and first and second matching circuits. The first coupling element defines a first port coupled to the ground plane for exciting the ground plane with radio signals. The first matching circuit is coupled at a first end to the first port, and is for attenuating radio signals within a first frequency band and for passing signals within a second frequency band. The first matching circuit also defines a feed end opposed to the first end. The second coupling element defines a second port coupled to the ground plane, and is also for exciting the ground plane with radio signals. The second matching circuit is coupled at a first end to the second port, and is for attenuating radio signals within the second frequency band and for passing signals within the first frequency band. The second matching circuit also defines a feed end opposed to its first end. Both feed ends are coupled to the transceiver by a common feed. Each of the first and second coupling elements is disposed adjacent to the transverse edge of the PWB and not overlying a major surface of the PWB.

These and other exemplary embodiments are detailed below.

BRIEF DESCRIPTION OF THE DRAWINGS

The foregoing and other aspects of the presently preferred embodiments of this invention are made more evident in the following Detailed Description of the Preferred Embodiments, when read in conjunction with the attached Drawing Figures.

DETAILED DESCRIPTION

Figure 1:
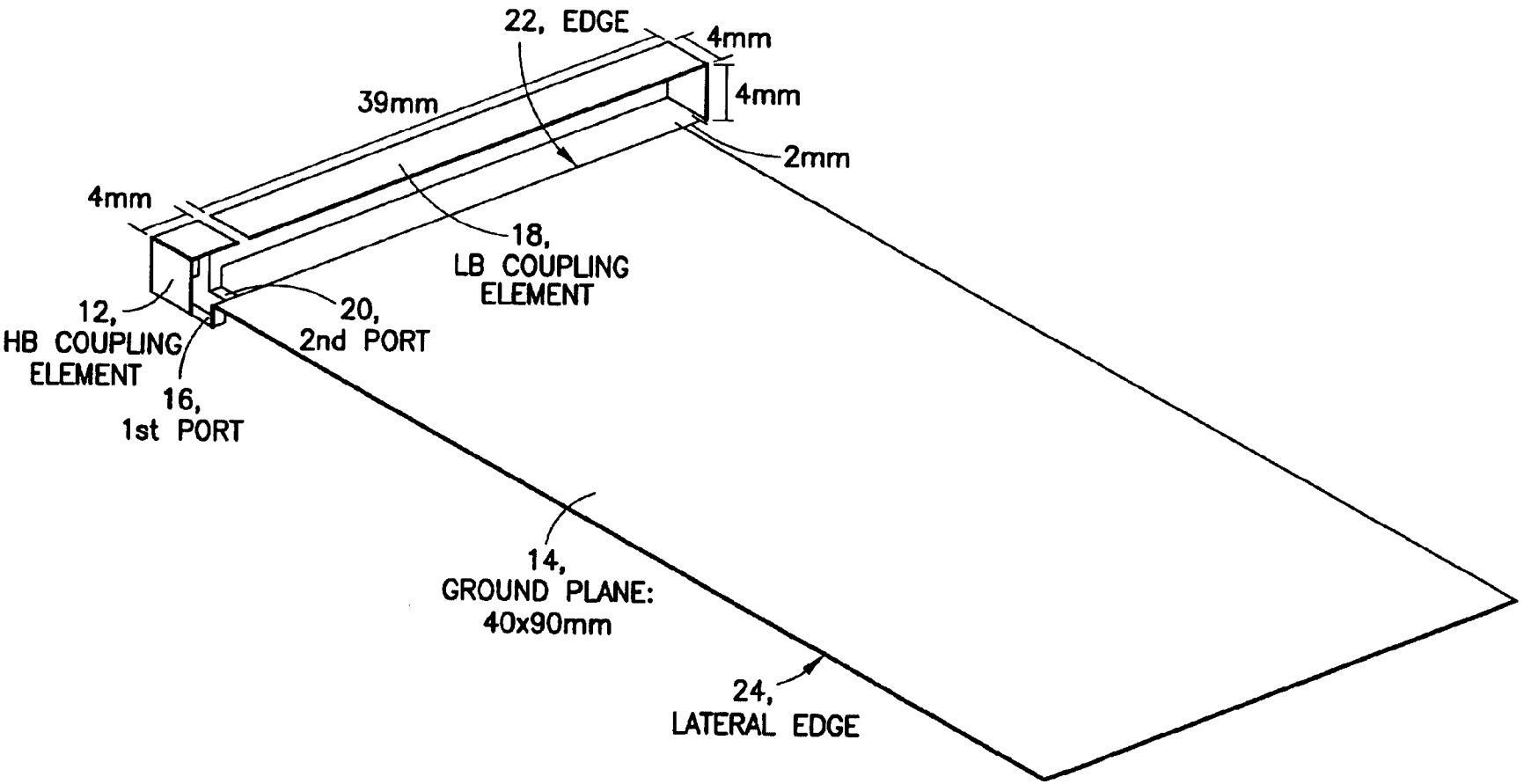
FIG. 1 shows the geometry of an embodiment of an antenna structure, excluding the matching circuits.

The disclosed antenna module may be disposed in any of several types of host devices, such as mobile stations, wireless laptop or palmtop computers, Blackberry™ type devices, portable internet tablets, or any other portable device in wireless communication over a LAN/WLAN, WiFi network, cellular/PCS network, piconetwork (e.g., Bluetooth), or the like. Whereas these teachings describe by example an antenna module adapted for wireless communications over the GSM 850/900/1800/1900 MHz frequency bands, different types of networks clearly operate on different operating frequencies to which an antenna module may be adapted according to these teachings. GSM 850 refers to frequencies 824-849 MHz (uplink) and 869-894 MHz (downlink), GSM 900 refers to frequencies 890-915 MHz (uplink) and 935-960 MHz (downlink), GSM 1800 refers to frequencies 1710-1785 MHz (uplink) and 1805-1880 MHz (downlink), and GSM 1900 refers to frequencies 1850-1910 MHz (uplink) and 1930-1990 MHz (downlink), though E-GSM expands the GSM 900 bands to 880-915 MHz (uplink) and 925-960 MHz (downlink) and R-GSM expands the GSM 900 bands to 876-915 MHz (uplink) and 921-960 MHz (downlink). These specific frequency bands may be amended over time by relevant implementing standards without departing from these teachings.

The disclosed antenna module operates when coupled to a chassis, or printed wiring board PWB, of a host device. The PWB carries a ground plane. The antenna module has coupling elements that receive wireless radiofrequency signals and feed them through a matching circuit to the ground plane of the PWB. In this manner, the PWB ground plane acts as the main resonator. More than one coupling element is used to enable signal reception over both low and high band frequencies, each coupling element generally coupling for two different but closely spaced frequency bands (e.g., high band 1800/1900 MHz; low band 850/900 MHz). The antenna module detailed below enables such multi (quad)-band reception in a particularly small volume by the position at which the coupling elements electrically connect to the ground plane, the size and shape of the coupling elements themselves, and by the specific matching circuits employed. As with all antennas, location within the host device is also a design factor, taking into account coupling with a user's head (as in the case of mobile stations) or hand (as is the case with any handheld host device). Whereas the coupling elements are resonant at their resonant frequencies, those of embodiments described herein need not be resonant at their operating frequencies as is typical of the prior art. While the resonant frequencies of the below-described coupling elements may indeed match the operating frequencies, such a design consideration is unnecessary. An aspect of this invention is that the coupling elements need not be resonant at the operating frequency/frequencies.

A variety of techniques can be used to tune an antenna element to desired frequency bands of operation. Of interest to this invention is the use of external matching components. Disclosed embodiments increase the isolation between and the matching of multiple ports of separate multi-band antennas. For clarity, the matching circuit is described herein as having "feeds" and the coupling elements are described to have "ports". The feeds of various branches of the matching circuit may be used separately or combined to one feed. Combining matching circuits into a single feed is particularly effective if the different frequency bands are well spaced from one another, for example 900/1800 MHz. A combined feed has also been shown to be effective with more closely spaced bands (for example the WCDMA Rx and Tx bands separated by about 130 MHz).

External matching circuitry for individual frequency bands (as seen through different antenna ports) are designed so that the antenna is matched, and in the same time the matching network operates as a band-pass filter. That is, the matching network has two primary functions: (a) matching the antenna, (b) increasing the isolation between different antenna ports. Further, this invention enables an antenna operable at frequencies that differ from the resonant frequencies of the coupling elements, giving a designer much greater latitude to optimize the coupling elements for the portable device in which they are to be disposed.

The use of the foregoing embodiments of the invention provide an additional degree of freedom in design of wideband/multiband antennas, as the same antenna structure can have multiple feed and ports with good isolation between the ports, and the feeds can be combined into a combined feed that also allows good isolation between the ports.

As was noted above, there exists a potential for more compact antenna structures than PIFAs, which more efficiently make use of the fundamentals of small antennas situated on a mobile station chassis. Described now is the use of substantially non-resonant (at the operating frequencies) coupling elements to excite the dominating characteristic wavemode of the chassis as efficiently as possible. Impedance matching to the transceiver electronics for a selected frequency can be achieved with matching circuits. This aspect of the invention employs multiple coupling elements and dual-resonant matching circuits to achieve a quad-resonant frequency response covering, as a non-limiting example, the GSM850/900/1800/1900 frequency bands. Employing the embodiments of the invention in mobile stations can considerably reduce the volume of the antenna structure as the size, shape and location of the coupling element can be selected so that the coupling to the chassis wavemode is optimal, rather than resonating at the operating frequencies. Further, these teachings can also be exploited in other than GSM-systems. For example, DVB-H/UMTS/WLAN antennas can be implemented in a very small volume by using the concept of non-resonant coupling elements, and by applying different matching network topologies, all in accordance with this embodiment of the invention. The reception band for DVB-H in the United States (US) is 1670-1675 MHz, and the reception band for DVB-H in the European Union is 470-702 MHz. Bands for UMTS (FDD) are 1920-2170 and for UMTS (TDD) are 1900-1920 (fdd1) and 2010-2025 (tdd2), whereas WLAN operating frequencies are in the GHZ range (e.g., 5 GHz for IEEE 804.11a and 2.4 GHz for IEEE 804.11b and g).

FIG. 1 illustrates two coupling elements, high band (HB) coupling element 12 is coupled (through a matching circuit, see FIG. 2) to a ground plane 14 by a first port pin 16, and low band (LB) coupling element 18 is coupled (through a matching circuit, see FIG. 2) to the ground plane 14 by a second port pin 20. Preferably, each coupling element 12, 18 is shaped as two adjacent sides of a square tube. Dimensions illustrated in FIG. 1 are exemplary and tailored specifically for GSM frequency bands. The HB coupling element 12 is optimized to cover the GSM1800/1900 bands while the LB coupling element 18 is optimized for the GSM850/900 bands, thus providing quad-band operation for the pair of coupling elements. Both HB 12 and LB 18 coupling elements are disposed beyond a (nearest) transverse edge 22 of the ground plane 14 and shaped optimally to achieve the strongest possible coupling to the chassis wavemode within the used volume. For reasons detailed below with respect to FIG. 7, it is important to note that the port pins 16, 20 are located near a lateral edge 24 of the ground plane, particularly the first port pin 16 of the HB coupling element 12. With the illustrated and exemplary dimensions, the coupling elements 12, 18 occupy a volume of only about 0.8 cc and may be made as small as about 0.7 cc. This is considered the smallest ratio of volume to bandwidth encountered by the inventors. The height of only about 4 mm makes the coupling elements 12, 18 particularly well suited for use in low-profile mobile stations. The bandwidth is increased by removing (as compared to prior art embodiments of multiband antennas) portions of the grounded segments 14*a* at the lateral (outboard) edges of the substrate 48, as shown particularly at FIG. 6G. Thus, the grounded segments 14*a* do not extend to lines defined by the lateral edges of the printed wiring board PWB 56.

Figure 2:
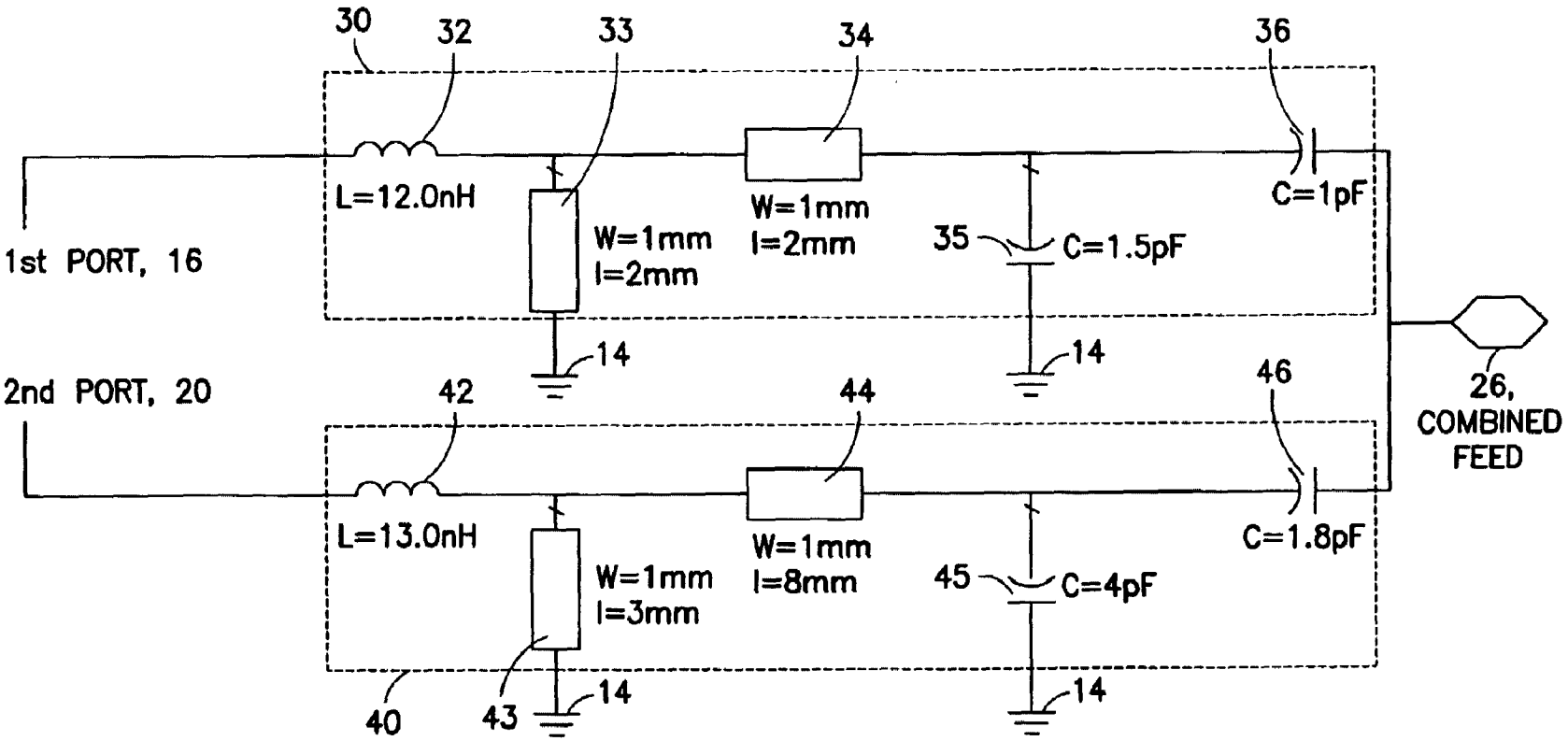
FIG. 2 is a schematic diagram showing an embodiment of a matching circuit topology including illustrative component values suitable for quad-band operation in the GSM1800/1900 and GSM850/900 bands.

In accordance with the invention each of the coupling elements 12, 18 has an associated matching circuit 30, 40, shown in the circuit diagram of FIG. 2. The matching circuits 30,40 of coupling elements 12 and 18 are preferably attached to the port pins 16 and 18, respectively, and implemented in the substrate of the antenna module by using lumped and distributed elements. Dual-resonant matching circuits 30, 40 are preferably used in both the lower and in the upper bands to achieve the desired quad-band frequency response for the antenna structure.

FIG. 2 presents a detailed schematic of the two matching circuits 30 and 40. The illustrated component types, electrical parameter values, and strip line dimensions are exemplary, suitable but not exclusively so for providing the desired quad-band operation in the GSM 1800/1900 and GSM850/900 bands. Such detailed disclosure is not to be construed as a limitation upon the scope of this invention. The matching circuits 30, 40 are preferably composed of inductors (inductance=L), capacitors (capacitance C) and microstrip lines (width=W, length=1). If desired, the microstrip lines can be replaced by inductors, and/or the lumped capacitors can be replaced by distributed capacitors. The matching circuit 30 shown in FIG. 2 is operable for the GSM1800/1900 band and is disposed between the HB coupling element 12 and a combined feed 26 that couples to a transceiver through a T/R switch or diplex filter (not shown). The matching circuit 40 is operable for the GSM850/900 band and is disposed between the LB coupling element 18 and the same combined feed 26.

Moving from the HB coupling element 12 and the first port pin 16 towards the feed 26, the basic principle of the dual-resonant matching circuit 30 is as follows. First, the capacitive HB coupling element 12 is tuned to single-resonance by employing a first series inductor 32 (inductance L=12 nH) and a first shorted microstrip line 33 (width w=1 mm, length 1=2 mm) in parallel with the first series inductor 32. The resonant frequency is tuned to the correct value by preferably adjusting the value of the first series inductor 32, and the size of the impedance circle on the Smith chart (see FIG. 4) can be tuned by changing the length of the first shorted microstrip line 33. When implementing a dual-resonant matching circuit, the impedance circle at this stage of the circuit design is preferably very small, i.e., the antenna structure should be strongly under-coupled. Following in the HB matching circuit 30 is a first series microstrip line 34 (w=1 mm, I=4 mm) and a first shorted capacitor 12D (C=1.5 pF) in parallel with the first series microstrip line 34. These two components operate to move the small impedance circle clockwise on the Smith chart of FIG. 4 to the 50 Ohm resistance circle. A first series capacitor 36 (C=1.0 pF) in series with between the first series microstrip line 34 and the feed 26 follows, and operates to move the impedance circle of FIG. 4 towards the center of the Smith chart, creating the dual-resonant frequency response for the two upper-frequency operational bands of the antenna structure (e.g., 1800 MHz and 1900 MHz).

Figure 4:
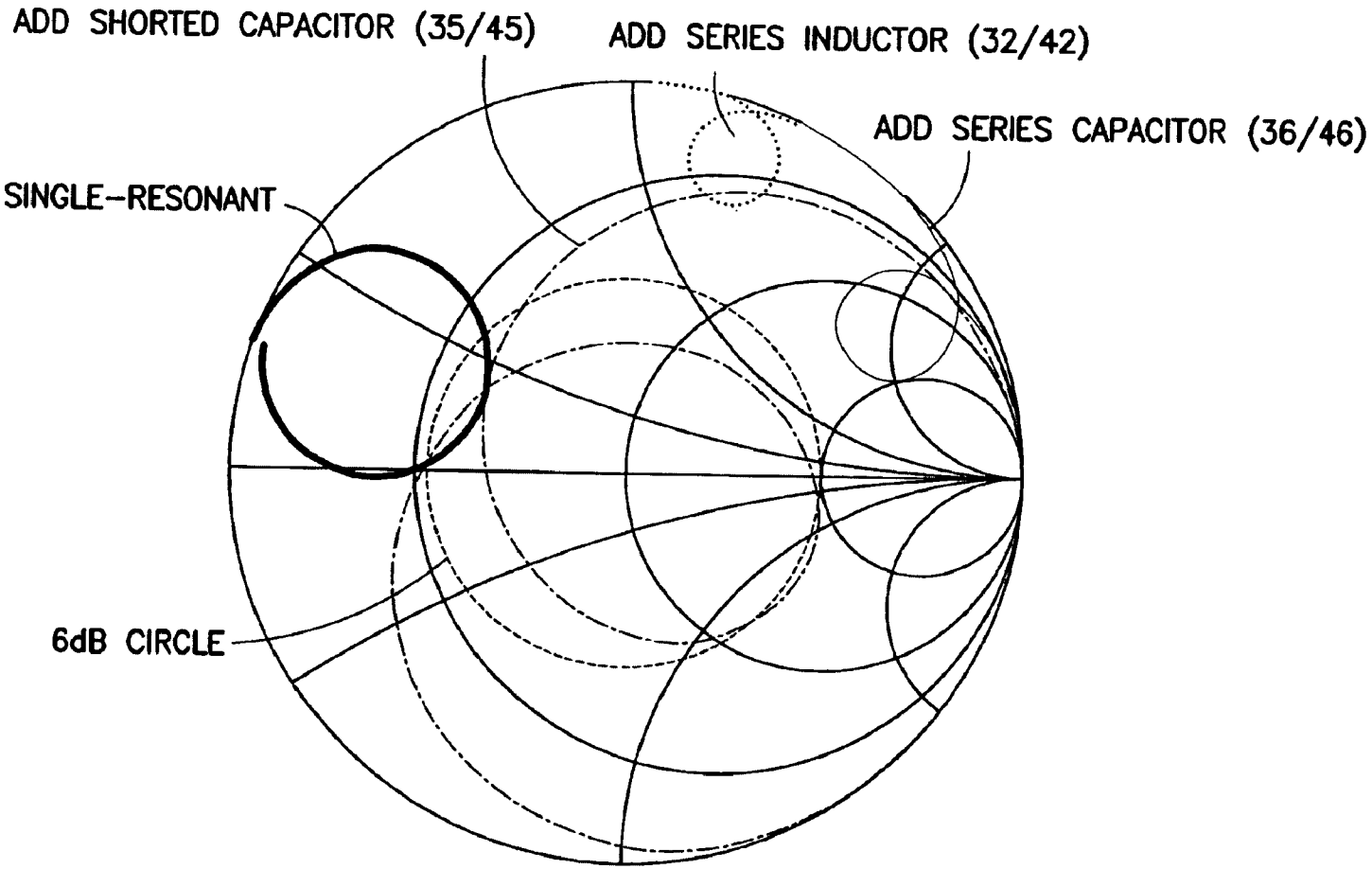
FIG. 4 shows a Smith chart illustrating movement of the input (to a transceiver) impedance circle as components of FIG. 2 are added.

The Smith chart of FIG. 4 shows movement of the input impedances (0.7 GHz to 1.1 GHz) as components described above with reference to FIG. 2 are added to a single-resonant circuit to achieve a dual resonant circuit. The input impedance circle for a single resonant circuit is shown, with subsequent movement annotated by addition of the individual lumped components. The center frequency is 920 MHz. Addition of striplines 33, 34, 43, 44 is not separately shown.

The LB matching circuit 40 is similar in structure to the HB matching circuit 30, with different electrical values as shown. Specifically, the series components between the second port 20 and the feed 26 include, in order, a second series inductor 42 (L=13.0 nH), a second series microstrip line 44 (w=1 mm, 1=8 mm), and a second series capacitor 46 (C=1.8 pF). Coupled between the second series inductor 42 and the second series microstrip line 44 is a second shorted microstrip line 43 (w=1 mm, 1=3 mm), and coupled between the second series microstrip line 44 and the second series capacitor 46 is a second shorted capacitor 45 (C=4 pF). After separately determining the proper matching circuit 30, 40 for each of the coupling elements 12, 18, the matching circuits 30, 40 are combined to a single feed 26. At the combining stage, it is important that the input impedance of the GSM850/900 matching circuit 40 at 1.8 GHz and the input impedance of the GSM1800/1900 matching circuit 30 at 0.9 GHz are made as high as possible. Otherwise, the two matching circuits 30 and 40 can disturb each other when combined.

In general, at any given time one of the coupling elements 12, 18 (depending upon which frequency band is being used for transmission/reception) excites currents onto the main PWB or ground plane 14, which acts as the main radiator. The relevant matching circuit 30, 40 matches the combined impedance of the PWB and the operative coupling element 12, 18 to a 50 Ohm transmission line at the combined feed 26.

Figure 3:
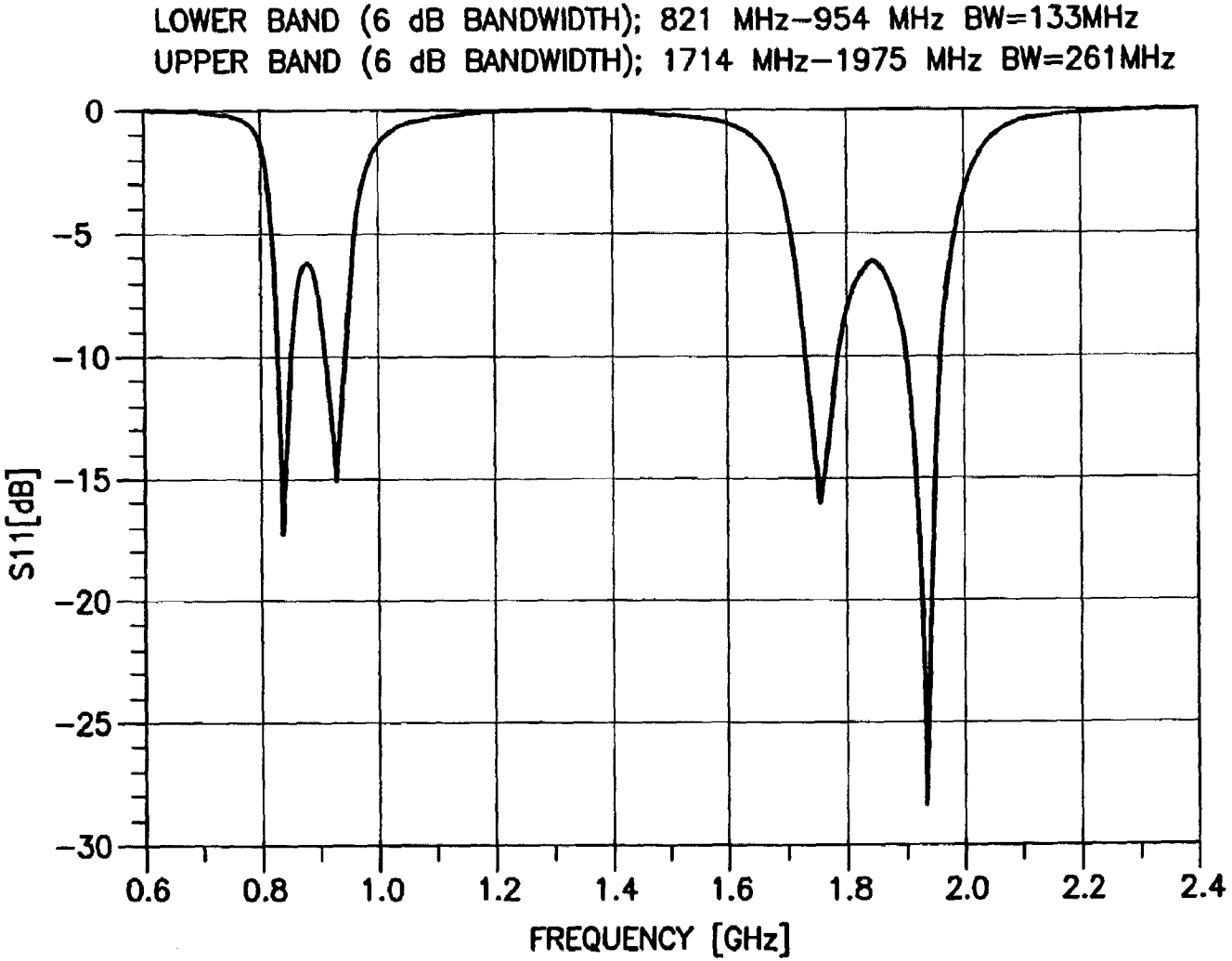
FIG. 3 shows a simulated return loss of the complete antenna structure as a function of frequency.
Figure 5:
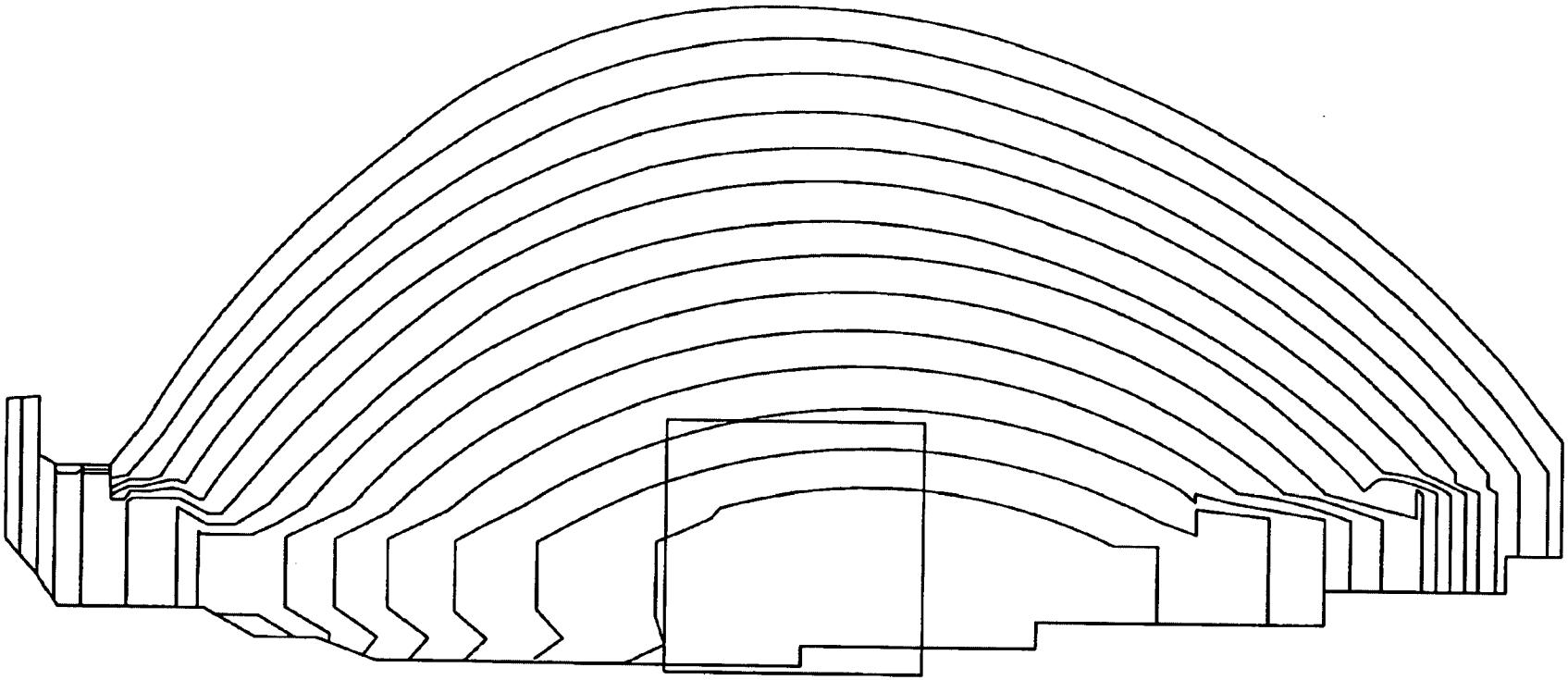
FIG. 5 shows a simulated SAR distribution (2-D slice view) within a phantom head model.

FIG. 3 presents a simulated return loss of the complete antenna structure as a function of frequency. In the simulation setup, S-parameter files are used to model the lumped components shown in FIG. 2. The simulated 6 dB bandwidth at the lower band is BW=954 MHz-821 MHz=133 MHz. The corresponding upper band bandwidth is BW=1975 MHz-1714 MHz=261 MHz. Thus, the antenna structure approximately fulfills the bandwidth requirements of the GSM850/900/1800/1900-systems according to the 6 dB criterion. The simulated total efficiency (including the matching losses) of the complete antenna structure in free space is over 55% at the GSM850/900 band and over 49% at the GSM1800/1900 band. The simulated SAR of the antenna structure (see FIG. 5) beside a homogenous head model (distance of the ground plane 14 from the head=7 mm) at 900 MHz is 2 W/kg. The value of the SAR, however, can be expected to be substantially lower when the antenna structure is implemented in a mobile station. The thin (thickness=0.2 mm) ground plane 14 used in the simulation is one reason for the high SAR. The simulated radiation efficiency beside the head model at 900 MHz is 16.3%. With a more realistic ground plane thickness, e.g. 3.6 mm, the radiation efficiency is estimated to be approximately 23%, or about 7% units lower than the radiation efficiency of a simple fully metallic PIFA beside a head model (7 mm distance from head).

Below is a table that enumerates values for the matching circuit efficiency, the coupling element and chassis radiation efficiency (without the matching circuits 30, 40), radiation efficiency of the complete antenna structure, and total radiation efficiency of the complete antenna structure for quad-band operation in the GSM 1800/1900 and GSM850/900 bands.

| | 824 MHz | 900 MHz | 960 MHz | 1710 MHz | 1830 MHz | 1990 MHz |
|---|---|---|---|---|---|---|
| Matching Circuit efficiency | 84.0% | 91.0% | 87.2% | 86.4% | 92.4% | 84.4% |
| Coupling Element + Chassis Radiation efficiency (no matching circuit) | 96.0% | 97.0% | 97.5% | 98.8% | 98.7% | 98.7% |
| Radiation efficiency (complete antenna structure) | 80.6% | 88.3% | 85.0% | 85.4% | 91.2% | 83.3% |
| Total efficiency (complete antenna structure) | 65.6% | 72.4% | 55.3% | 59.8% | 70.2% | 49.1% |

The specific matching circuits of FIG. 2 are exemplary; other circuit architectures can be derived to implement dual-resonant matching circuits. In addition to the series inductor and parallel inductor combination used in the illustrated embodiment of the invention (e.g., at one resonant frequency, one inductor 32 or 42 is in series between the operative coupling element and the feed, and the other 42 or 32 is in parallel), a capacitive coupling element may be tuned to single-resonance by, as non-limiting examples, the use of a series inductor and a parallel capacitor; or the use of a parallel inductor and a series inductor; or the use of a parallel inductor and a series capacitor. The generated small impedance circle is then preferably moved in the Smith chart to either the 50 Ohm resistance circle or to the corresponding conductance circle. This can be accomplished in various ways by using inductors, capacitors, or microstrip lines in series or in parallel. In the 50 Ohm resistance and conductance circles, either the capacitive or the inductive side of the circle can be selected. In the final stage, the impedance circle is moved to the center of the Smith chart. Depending on the location of the impedance circle on the Smith chart, this can be accomplished by using series inductors, parallel inductors, series capacitors, or parallel capacitors.

Thus, it should be appreciated that there are numerous different techniques to implement the dual-resonant matching circuit for a capacitive coupling element, and that all of these various techniques are within the scope of this invention. Further, either or both of the matching circuits 30, 40 need not be operative across two bands; either or both may be adapted for only a single operational frequency band. For example, in certain instances is may be advantageous to use a single-resonant matching circuit for the upper band and a dual-resonant matching circuit for the lower band where bandwidth is typically more limited. Implementation requires only adapting the arrangement of electrical components (capacitors, inductors, striplines, locations of shorts) of the matching circuit(s) 30, 40 to match the desired band, without the need to also adapt the coupling elements 12, 14. This is because the coupling elements 12, 14 need not be resonant at the operational frequencies. Although different implementations can provide approximately the same bandwidth, some implementations result in more reasonable component values than others. From a lumped element quality factor point of view, small component values are preferable. The matching network (matching circuits 30, 40) shown in FIG. 2 is a preferred embodiment for matching the coupling elements 12, 18 of the antenna structure. However, for another coupling element structure the matching network topology shown in FIG. 2 may not provide optimal performance.

Various advantages can be realized by the use of the embodiments of this invention. As a non-limiting example, very low-volume and low-profile antenna structures can be implemented. As another non-limiting example, the coupling elements 12, 18 are separate units from the matching circuits 30, 40, and need not be tuned to resonance. Therefore, the location, size and shape of the coupling elements 12, 18 can be chosen individually to achieve the best available performance. In addition, even at very low frequencies, compact coupling elements 12, 18 can be used without meandering. As another non-limiting example of an advantage realized by the use of the embodiments of this invention, since the matching circuits 30, 40 can be designed separately from the coupling elements 12, 18, the technology and structure can be selected in a flexible manner, and lumped and distributed elements can be used. In addition, the matching circuits 30,40 can, as an example, be integrated beneath one or both of the coupling elements 30, 40 on a printed circuit board (PCB) of a mobile station. Integration of the matching arrangement of an antenna on the PCB facilitates the implementation of electrically tunable antennas, e.g. for Rx-Tx switching.

It should be appreciated that the use of the embodiments of this invention solves the problem of providing a good quad-band GSM, or other, antenna. While one may attempt to do this by generating a dual-resonance at both the GSM850/900 and GSM1800/1900 bands (four resonances in total), this is difficult to accomplish by simply cutting and arranging copper tape. The use of series resonant circuits with PIFAs, however, simplifies the task such that, ideally, one can use any combination of two PIFAs that cover the GSM850 and GSM1800 frequencies to form quad-band GSM antennas. The possibility to optimize the antennas separately facilitates the design. However, two separate feeds for a quad-band GSM antenna may be incompatible with the RF front end of the mobile station.

In accordance with embodiments of this invention the series resonant circuits 30, 40 act as band-pass filters that appear as high impedances (e.g., substantially open circuits) outside of the pass band (e.g., leading to large isolation between ports), and one may then combine the two feeds directly (as shown in FIG. 2), or through a short section of transmission line, without any additional components or excessive antenna tuning to make the matching solution compatible with a single feed RF front end fed from an RF power amplifier.

Figure 6A:
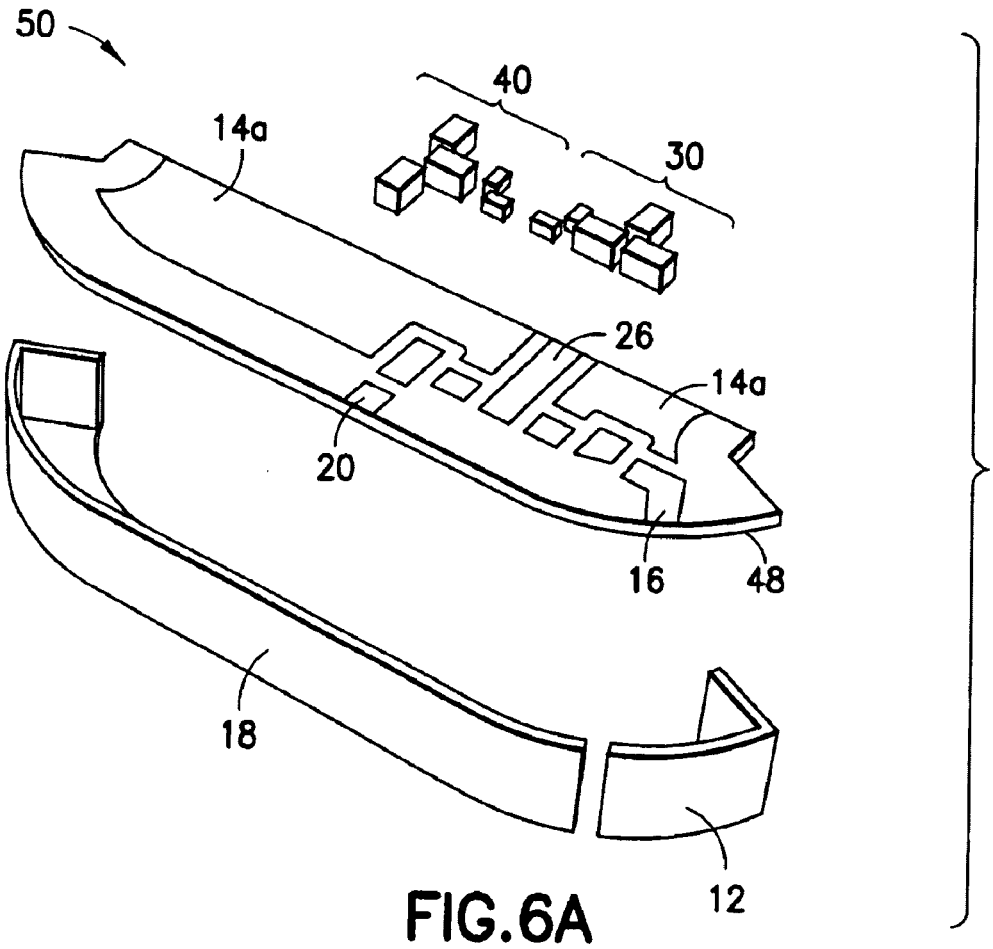
FIG. 6A is an exploded view of the coupling elements, discrete circuit components, and substrate that together form an antenna module.

Further implementation details are detailed at FIGS. 6A-6G. FIG. 6A shows the antenna module 50 in exploded view. Individual electrical components of the matching circuits 30, 40 are shown in block form above a substrate 48 which has conductive traces made of copper, aluminum, or other conductive material disposed on its surface that define the combined feed 26, the first and second ports 16, 20, and conductive lines that couple the components of the matching circuits 30,40 once they are mounted. Of note also on the substrate are two distinct grounded segments 14*a* that are coupled to the ground plane 14 when the antenna module 50 is mounted to a PWB 56 with an internal ground plane 14. Note that the HB coupling element 12 and the LB coupling element 18 are arcuate near their outboard edges. This is to particularly adapt the shape of the coupling elements 12, 18 to the volume defined by the mobile station body (FIG. 6D), which is generally rounded about its four corners.

Figure 6B:
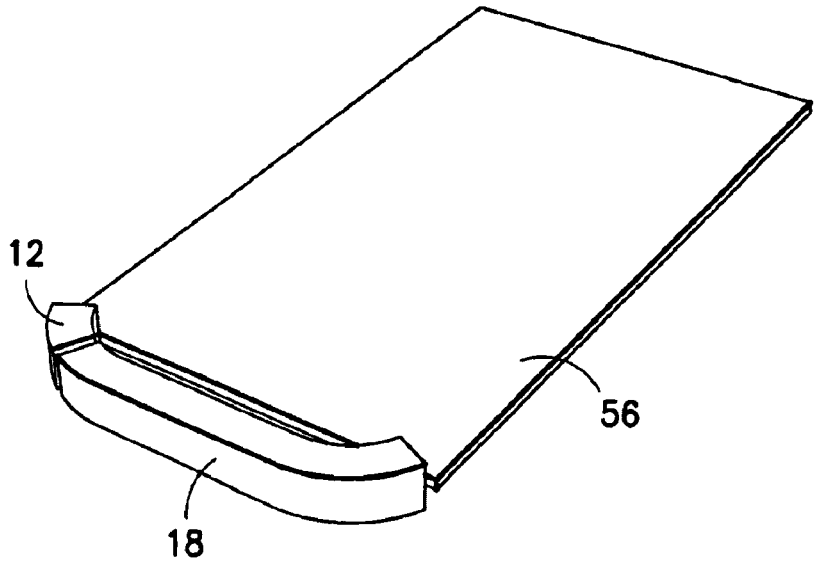
FIG. 6B is similar to FIG. 6A, but showing the antenna module from a different perspective as compared to FIG. 6A, and in an assembled form coupled to a ground plane.

FIG. 6B illustrates the antenna module 50 mounted to the PWB 56. The perspective of FIG. 6B is from the underside of the antenna module 50 as compared to FIG. 6A, given the reversed relative disposition of the HB coupling element 12 and the LB coupling element 18, so the matching circuits 30, 40 are not visible.

Figure 6C:
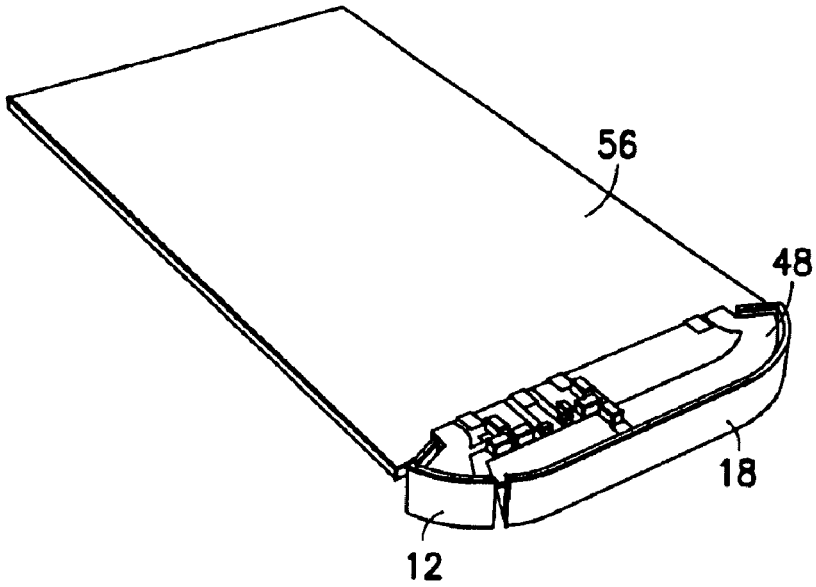
FIG. 6C is similar to FIG. 6B but from a perspective similar to that of FIG. 6A.
Figure 6D:
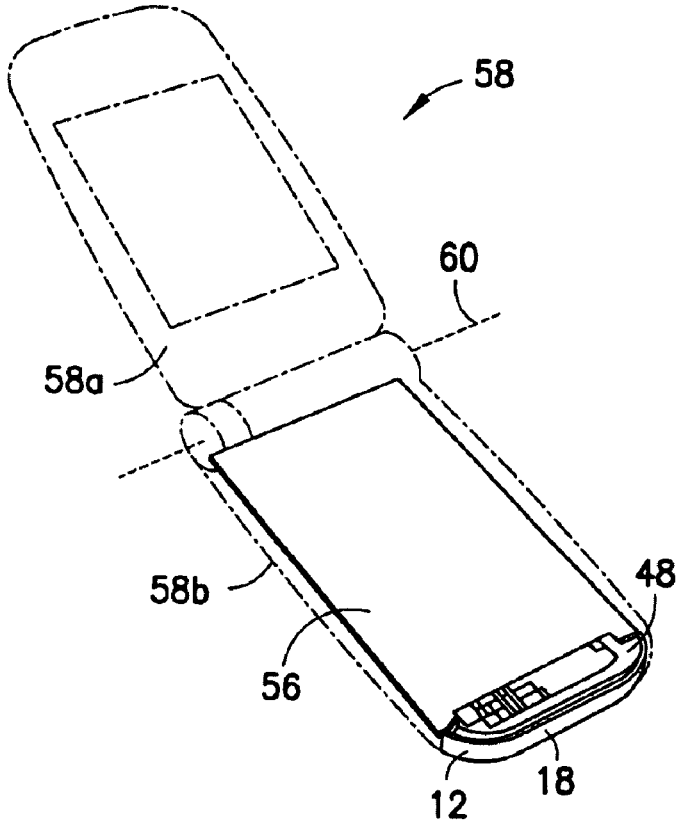
FIG. 6D is similar to FIG. 6C, but showing the antenna module and ground plane disposed within a mobile station having two main body components movable relative to one anther.

FIG. 6C illustrates the antenna module 50 coupled to the PWB 56 from a perspective similar to that of FIG. 6A, where components of the matching circuits 30,40 are visible. Further detail in this regard is described below with respect to FIGS. 6E-6G. FIG. 6D illustrates the antenna module 50 coupled to the PWB 56 and disposed within a mobile station 58. The mobile station 58 includes a body having two main components 58*a*, 58*b* movable relative to one another, in this instance along a hinge axis 60. The PWB 56 occupies substantially an area of one body component 58*b*, and the antenna module 50 is disposed opposite the hinge axis 60 and nearer where a microphone (not shown) would be. This is for two reasons: to limit radiation to the upper portion of a user's head, and to minimize interference by a user's hand with the coupling elements. While a flip-type phone is shown, similar disposition is also preferable in slide-type phones (e.g., Nokia model 6111) where the two major body components are slideable relative to one another.

Figure 6E:
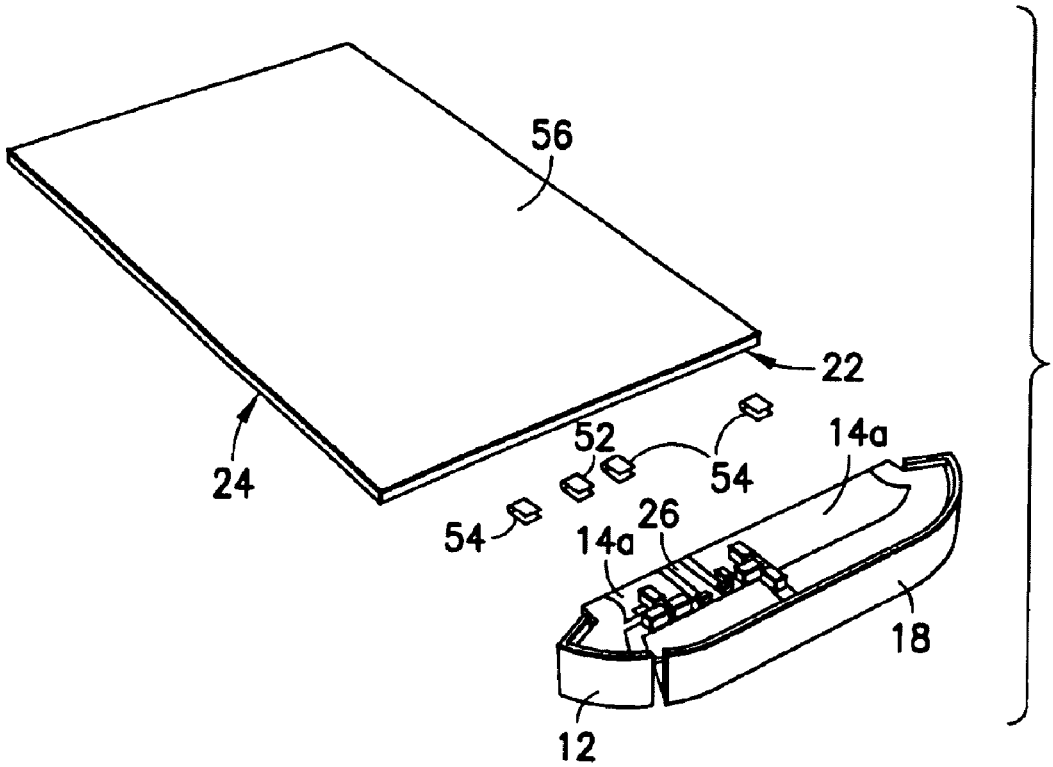
FIG. 6E is similar to FIG. 6C, but showing the antenna module and ground plane separated from one another to illustrate conductive clips by which they are mounted.
Figure 6F:
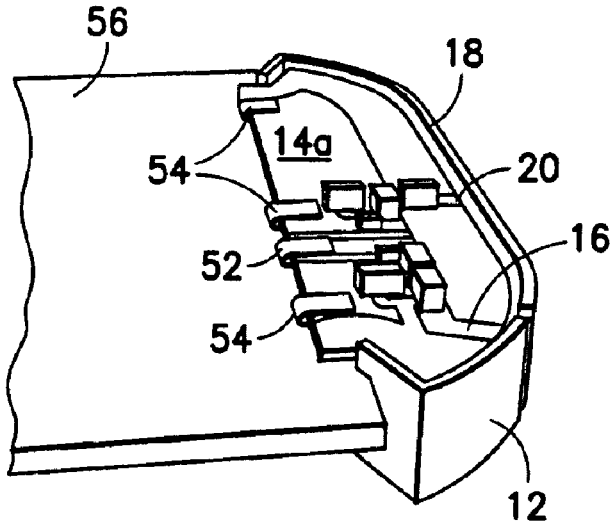
FIG. 6F is similar to FIG. 6E but showing the antenna module counted to the ground plane with the conductive clips.

Detail as to how the antenna module 50 couples to the PWB 56 is shown particularly at FIGS. 6E-6F. An S-type clip made of a conductive material is used in two different functions, as an active clip 52 to couple the combined feed 26 to a T/R switch or diplex filter and the transceiver (not shown), or as a grounding clip 54 (three shown) to couple the grounded segments 14*a* of the antenna module 50 to the actual ground plane 14 of the PWB 56. As will be shown in FIG. 6G, the shorted components 3, 35, 43, 45 of the matching circuits 30, 40 make electrical contact to the ground plane 14 through the grounded segments 14*a* and the grounding clips 54.

Figure 6G:
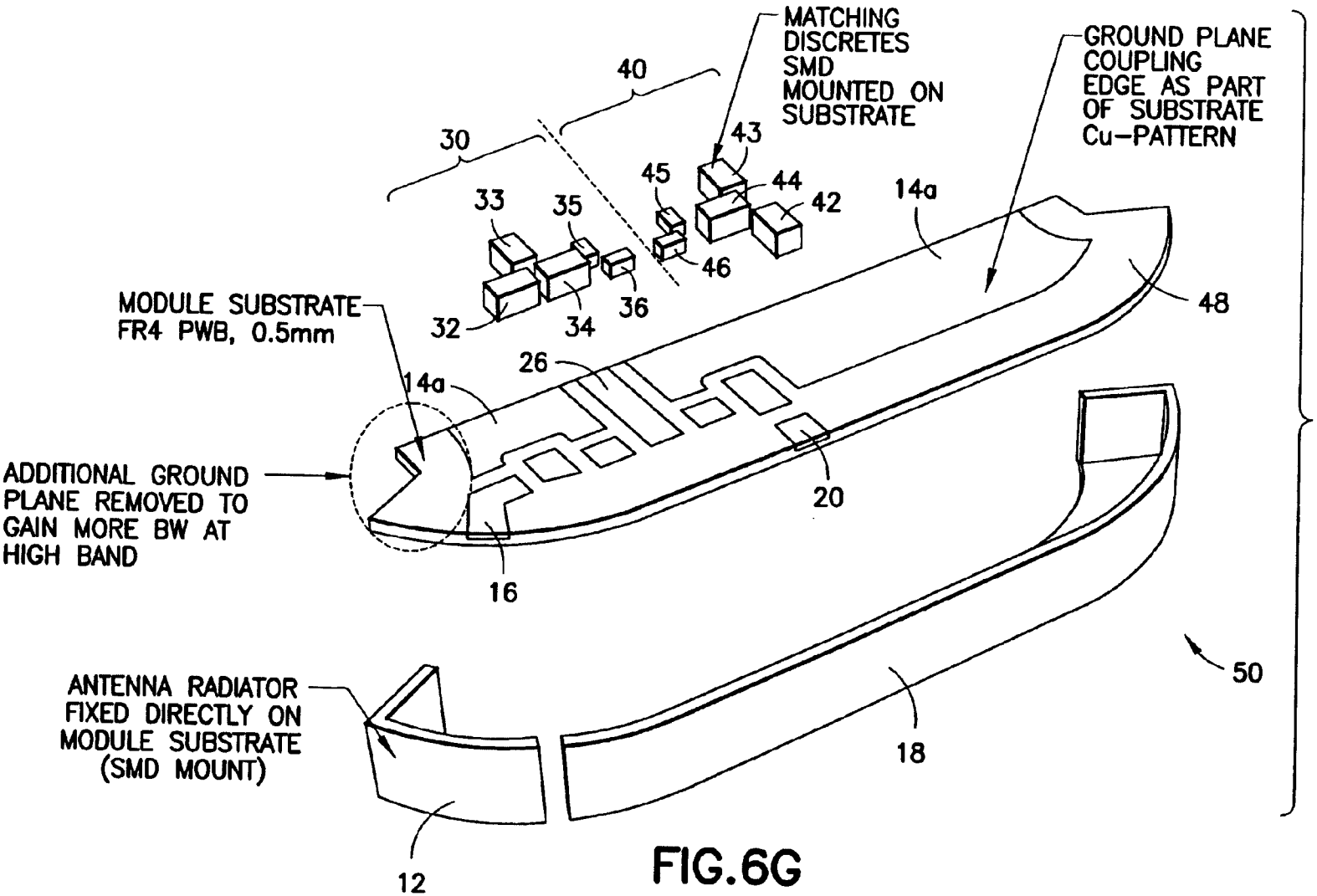
FIG. 6G is similar to FIG. 6A but showing further detail.

FIG. 6G shows in further detail the distinct components of the matching circuits 30, 40 from FIG. 2. The HB coupling element 12 connects to the first matching circuit 30 at the first port 16, and the LB coupling element 18 connects to the second matching circuit 40 at the second port 20. Both matching circuits 30, 40 output at a combined feed 26. Shorted elements 33, 35, 43, 45 of the matching circuits 30, 40 couple to the grounded segments 14*a* of the antenna module 50. The HB coupling element 12 and the LB coupling element 18 are fastened to the substrate 48 directly. In this manner, the entire antenna module 50 may be manufactured and handled separately as an integrated unit, attached to the PWB 56 by the simple clips 52, 54 and disposed within the body of a mobile station 58. The advantage of an antenna module 50 made on a single substrate 48 separate from the PWB 56 is that such an antenna module 50 may be married to different PWBs. This is seen as a manufacturing advantage over fabricating a main PWB 56 having matched circuitry for the antenna on it, since less changes need be made to the more expensive PWBs when the matched circuitry for the antenna is on a separate antenna module 50.

Figure 7:
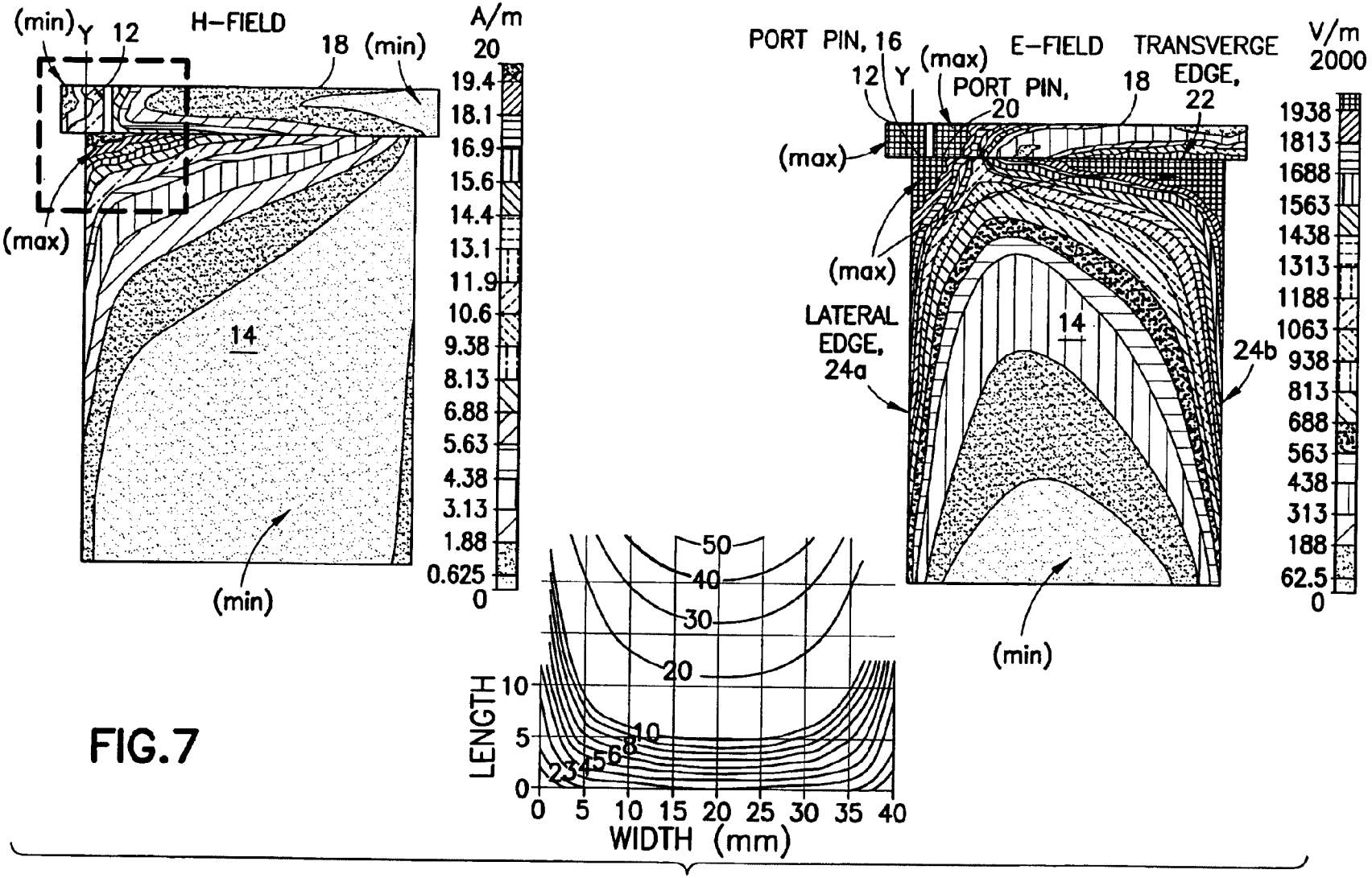
FIG. 7 shows magnetic and electric field intensities at the ground plane and coupling elements.

FIG. 7 illustrates a plan view outline of the ground plane 14 and coupling elements 12, 18 of FIG. 1 with magnetic (H) and electric (E) field strengths indicated. The black and white reproductions fail to differentiate the strongest from the weakest fields. For magnetic intensity, the strongest H-field occurs at the upper left hand corner of the ground plane 14 and the weakest along the majority surface of the ground plane and the outboard edges of the coupling elements 12, 18, weakest indicated by (min) and strongest indicated by (max). Similar nomenclature (min) and (max) indicate weakest and strongest E-field intensity, the strongest along the lateral edges 24 of the ground plane 14 near the transverse edge 22 nearest the coupling elements 12, 18.

Strong coupling to the chassis wavemode occurs when the coupling elements 12, 18 are coupled to the ground plane 14 at a point of maximum E-field intensity. By adapting the shape of the HB coupling element 12 to extend beyond a (first) lateral edge 24*a* of the ground plane 14/PWB 56, a portion of the LB coupling element 18 that exhibits a maximum E-field intensity (e.g., the inboard edge that lies adjacent to the LB coupling element 18) may be brought into alignment with a location of maximum E-field intensity of the ground plane 14 and coupled there. The locations of the first and second port pins 16 and 20, respectively, are shown in FIG. 7 to illustrate their locations relative to E-field intensity of both the ground plane 14 and the coupling elements 12, 18. For each coupling element 12 and 18 and the ground plane 14, coupling is at locations of localized maximum E-field intensity. The shape of the LB coupling element 18 is adapted to extend beyond the opposed lateral edge 24*b* of the ground plane 14 to the same extent that the HB coupling element 12 extends beyond the (first) lateral edge 24*a*. Additionally, and unlike the prior art wherein coupling elements are sometimes disposed to overlie a segment of the ground plane, the coupling elements 12, 18 are disposed adjacent to a transverse edge 22 but not overlying a major surface of the ground plane 12. Among other design considerations, this disposition relative to the ground plane 14 leaves the coupling elements 12, 18 largely non-resonant at the desired operating frequencies.

Figure 8A:
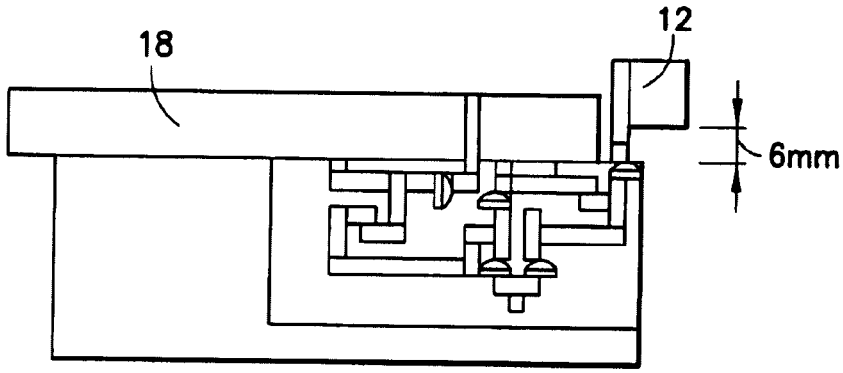
FIG. 8A shows a Smith chart for the high band when the high band coupling element is spaced from an edge of the PWB as illustrated at the top of FIG. 8A.
Figure 8A:
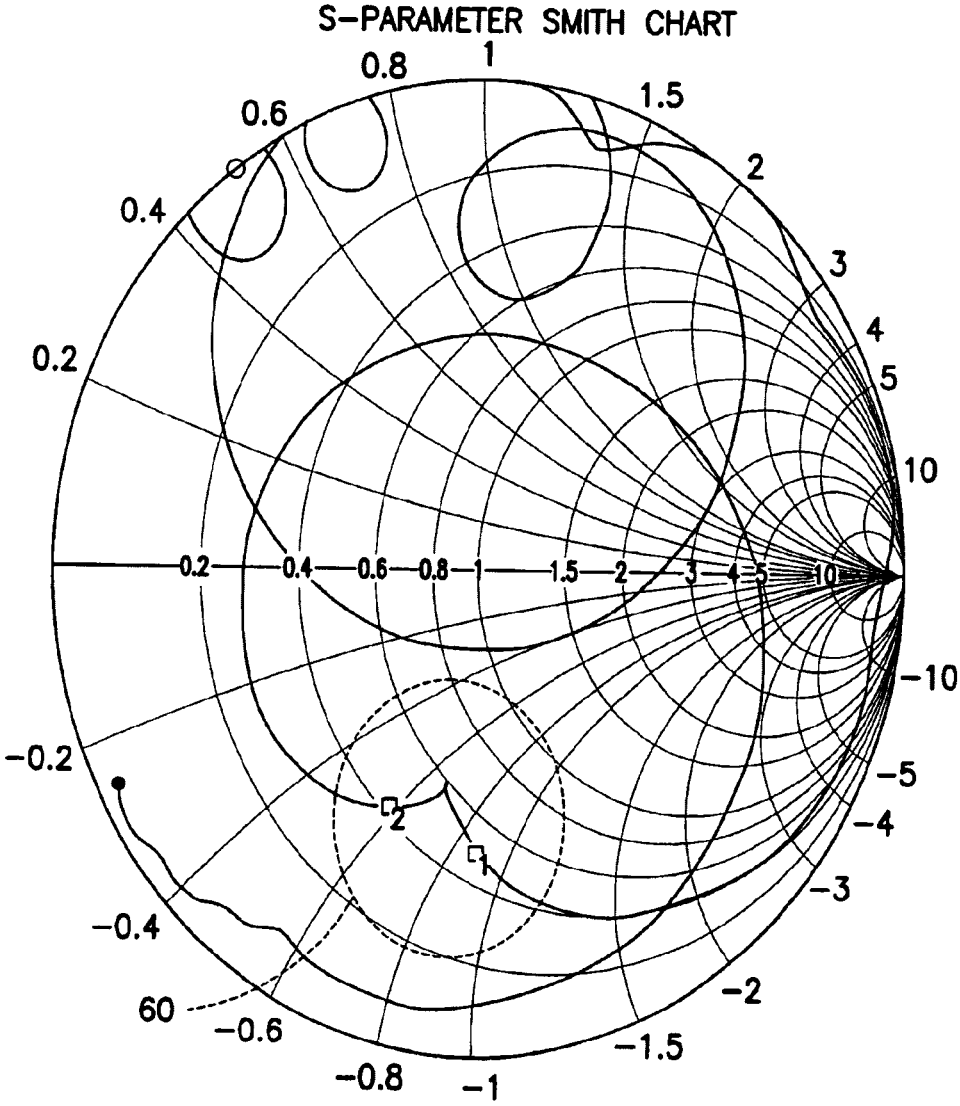
Figure 8B:
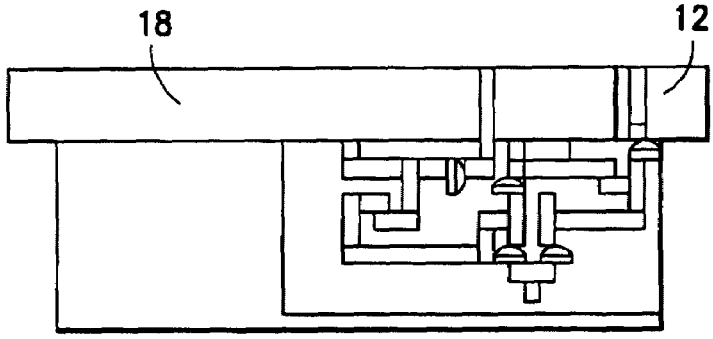
FIG. 8B shows a Smith chart for the high band when the high band coupling element is immediately adjacent to an edge of the PWB as illustrated at the top of FIG. 8B.
Figure 8B:
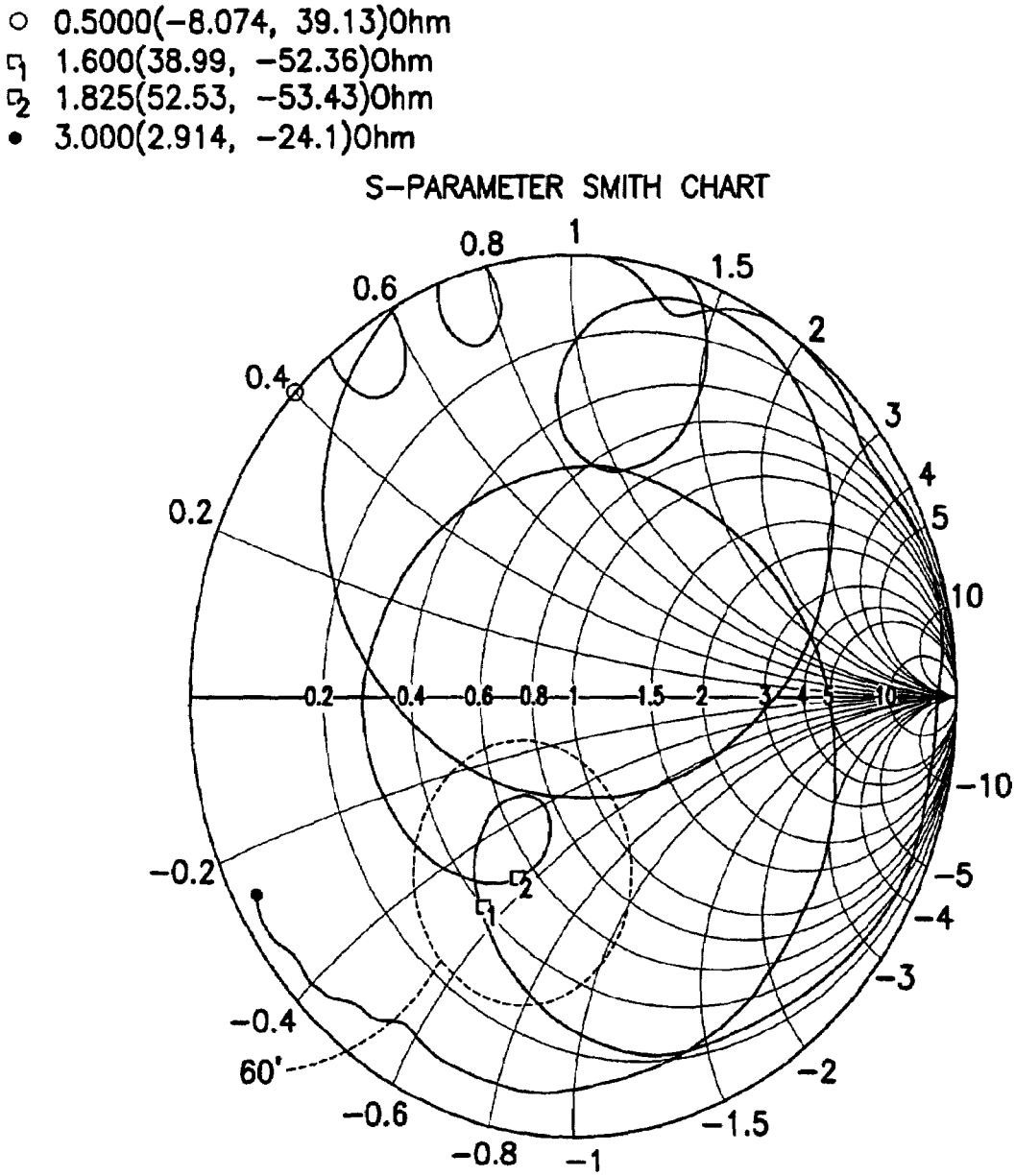

FIG. 8A is a Smith diagram for the configuration where the HB coupling element 12 is moved 6 mm further from the nearest transverse edge 22 of the ground plane 14 as compared to the LB coupling element 18. FIG. 8B illustrates the configuration of all other embodiments where both the HB coupling element 12 and the LB coupling element 18 lie adjacent to that edge. Each diagram further includes a block illustration of the antenna module 50 directly above the Smith diagram. Ripple uncertainties from resonance in the low band are evident in the area of interest 60 in FIG. 8A is compared to the similar area of interest 60' of FIG. 8B. This is not seen as a particularly adverse characteristic as they arise only in the low band when the antenna module operates in the high band, and low band signals are intentionally attenuated by the LB matching circuit 40 (FIG. 2) when operating in the high band.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. As but some examples, the use of other similar or equivalent circuit topologies, component values, frequency bands and antenna types may be attempted by those skilled in the art. However, all such and similar modifications of the teachings of this invention will still fall within the scope of the embodiments of this invention. Furthermore, some of the features of the disclosed embodiments of this invention may be used to advantage without the corresponding use of other features. As such, the foregoing description should be considered as merely illustrative of the principles, teachings and embodiments of this invention, and not in limitation thereof.

What is claimed is:

1. An antenna module comprising:

a substrate;

a first coupling element mounted to the substrate and particularly adapted to couple a first frequency band to a ground plane through a first port;

a second coupling element mounted to the substrate and particularly adapted to couple a second frequency band to a ground plane through a second port;

a first resonant matching circuit coupled to the first port and disposed on the substrate, said first matching circuit comprising a plurality of components having electrical values selected so as to function as a band-pass filter within the first frequency band and to present a high impedance at least in the second frequency band; and a second resonant matching circuit coupled to the second port and disposed on the substrate, said second matching circuit comprising a plurality of components having electrical values selected so as to function as a band-pass filter within the second frequency band and to present a high impedance at least in the first frequency band.

2. The antenna module of claim 1, further comprising a common feed to which the first and second resonant matching circuits are coupled, said common feed for coupling to a transceiver.

3. The antenna module of claim 1, where the first frequency band comprises GSM1800/1900, and the second frequency band comprises GSM 850/900.

4. The antenna module of claim 1, where each of the first and second resonant circuits further comprise a shorted component that is shorted to a grounding segment disposed on the substrate.

5. The antenna module of claim 4, wherein each of the first and second resonant circuits further comprise an inductor in series with a capacitor, and the shorted component disposed between said inductor and capacitor.

6. The antenna module of claim 5, wherein each of the first and second resonant circuits further comprise a microstrip element having dimensions selected to function as the band-pass filter for its respective matching resonant circuit.

7. The antenna module of claim 4, wherein each of the first and second resonant circuits further comprise a shorted capacitor and a shorted stripline element that are shorted to the grounded segment.

8. The antenna module of claim 1, coupled by the first and second ports to respective first and second locations of a printed wiring board PWB, said first and second locations each exhibiting an elevated E-field intensity when in operation.

9. The antenna module of claim 8, wherein the first and second locations are along a transverse edge of the PWB.

10. The antenna module of claim 9, wherein the first frequency band is higher than the second frequency band, and the first location is nearer a lateral edge of the PWB than the second location.

11. The antenna module of claim 10 in combination with a mobile station that comprises first and second major body sections that are moveable relative to one another between open and closed positions, said module disposed in a first body section such that it lies furthest from the second body section when said sections are in the open position.

12. The antenna module of claim 8, wherein the first and second coupling elements are disposed adjacent to a transverse edge of the PWB and not overlying a major surface of the PWB.

13. A multi-band antenna comprising:

a ground plane;

a first coupling element defining a first port coupled to the ground plane for exciting the ground plane with radio signals;

a first matching circuit coupled at a first end to the first port for attenuating radio signals outside a first frequency band, and defining an opposed feed end;

a second coupling element isolated from the first coupling element and defining a second port coupled to the ground plane for exciting the ground plane with radio signals;

a second matching circuit coupled at a first end to the second port for attenuating radio signals outside a second frequency band, and defining an opposed feed end;

wherein the feed ends are connected at a common feed for coupling to a transceiver, and the first and second coupling elements are disposed adjacent to a transverse edge of the ground plane and not overlying a major surface of the ground plane.

14. The multi-band antenna of claim 13, wherein the first and second matching circuits comprise an identical topology of electrical components and vary from one another in at least one electrical parameter value.

15. The multi-band antenna of claim 14, wherein each of the first and second matching circuit comprises series components and shorted components, and an electrical parameter value differs among the first and second matching circuits in at least one identical series component and at least one identical shorted component.

16. The multi-band antenna of claim 13, wherein the ground plane comprises a portion of a printed wiring board PWB, and the PWB is disposed in one main body section of a mobile communications device that comprises two main body sections moveable relative to one another, and wherein the coupling elements are disposed near an end of the one main body section that is furthest from the other main body section when in the open position.

17. A method for coupling an antenna main radiator element to a transceiver, comprising:

providing a printed wiring board PWB;

coupling a first coupling element to the PWB at a first port and a second coupling element to the PWB at a second port, the first and second coupling elements for exciting currents within respective first and second radiofrequency RF bands to the PWB;

disposing a first matching circuit between the first port and a transceiver for passing currents within the first RF band and attenuating currents within the second RF band; and disposing a second matching circuit between the second port and a transceiver for passing currents within the second RF band and attenuating currents within the first RF band, wherein the first and second RF bands do not overlap.

18. The method of claim 17, wherein the first and second matching circuits join in a common feed, said common feed for coupling to a transceiver.

19. The method of claim 17, wherein the first band includes at least GSM 850/900, and the second band comprises at least GSM 1800/1900.

20. The method of claim 17, wherein coupling the first and second coupling elements to the PWB comprises disposing the first and second coupling elements adjacent to a transverse edge of the PWB but not overlying a major surface of the PWB.

21. A mobile terminal comprising:

a first and a second main body section moveable relative to one another between an open and a closed position;

a transceiver;

a printed wiring board PWB defining a ground plane and disposed in the first main body section and defining opposed lateral edges and a transverse edge; and an antenna module comprising a first coupling element defining a first port coupled to the ground plane for exciting the ground plane with radio signals;

a first matching circuit coupled at a first end to the first port for attenuating radio signals within a first frequency band and passing signals within a second frequency band, said first matching circuit defining an opposed feed end;

a second coupling element defining a second port coupled to the ground plane for exciting the ground plane with radio signals; and a second matching circuit coupled at a first end to the second port for attenuating radio signals within the second frequency band and passing signals within the first frequency band, said second matching circuit defining an opposed feed end;

wherein the feed ends of the first and second matching circuits couple to the transceiver by a common feed, and further wherein each of the first and second coupling elements are disposed adjacent to the transverse edge of the PWB and not overlying a major surface of the PWB.

22. The mobile terminal of claim 21, wherein the antenna module further comprises a substrate on which the first and second matching circuits are disposed, said substrate further comprising at least one grounded segment through which the first and second matching circuits are shorted to the ground plane, and wherein each grounded segment to which a matching circuit is shorted does not extend to a line defined by either lateral edge of the PWB.

* * * * *